United States Patent [19]

Bolldorf et al.

[11] 4,285,289

[45] Aug. 25, 1981

[54] EMBROIDERING MACHINE

[75] Inventors: Kurt Bolldorf, Kaiserslautern; Gottfried Schmidt, Klein-maischeid, both of Fed. Rep. of Germany

[73] Assignee: Pfaff Industriemaschinen GmbH, Fed. Rep. of Germany

[21] Appl. No.: 186,122

[22] Filed: Sep. 11, 1980

[30] Foreign Application Priority Data

Sep. 26, 1979 [DE] Fed. Rep. of Germany ..... 2938894

[51] Int. Cl.[3] ..... D05C 3/02; D05B 55/16; D05B 29/02

[52] U.S. Cl. ..... 112/98; 112/79 R; 112/221; 112/237; 112/242

[58] Field of Search ..... 112/83, 87, 98, 79 R, 112/221, 237, 239, 242

[56] References Cited

U.S. PATENT DOCUMENTS

| | | | |
|---|---|---|---|
| 1,080,915 | 12/1913 | Keller | 112/83 |
| 1,086,470 | 2/1914 | Schoenfeld | 112/83 |
| 3,177,834 | 4/1965 | Unscheler | 112/83 |
| 3,259,088 | 7/1966 | Rockholt | 112/221 X |
| 3,349,733 | 10/1967 | Ree | 112/83 |

FOREIGN PATENT DOCUMENTS

| | | | |
|---|---|---|---|
| 65330 | of 0000 | Switzerland | 112/221 |

*Primary Examiner*—H. Hampton Hunter
*Attorney, Agent, or Firm*—McGlew and Tuttle

[57] ABSTRACT

An embroidering machine comprises a plurality of embroidering head each equipped with a plurality of needles formed into a group each with its thread. A needle bar is engageable with one needle at a time in the group to bring the needle from a rest position thereof into an operating position. A presser foot mechanism with a presser foot attached cyclically moves the presser foot upwardly and downwardly from an upper dead center position to a lower dead center position. The presser foot is provided with a hole for the passage of the one needle. Thread cutting and holding devices are provided for cutting the thread of the one needle to form a thread end portion and hold the thread end portion. Upon the termination of an embroidering operation with the one needle, the presser foot mechanism is operable to move the presser foot substantially transversely to a longitudinal axis of the needles and, after the thread is cut, to lift the presser foot upwardly beyond its upper dead center position. The holding device includes a shield for shielding the points of the needles in a rest position and a chamber having an open bottom and top end with compressed air nozzle for directing the thread end portions into the chamber to secure the thread end portions.

16 Claims, 4 Drawing Figures

EMBROIDERING MACHINE

FIELD AND BACKGROUND OF THE INVENTION

The present invention relates in general to sewing machines and in particular to a new and useful embroidering machine wherein groups of threaded needles are utilized, one at a time, to produce embroidery.

To obtain an embroidery having a neat appearance, it is desirable to conceal the ends of both the locking threads and the needle threads on the underside of the embroidered work. To this end, the embroidering threads are cut in such a way that the cut needle-thread ends carried by the needles are sufficiently, but not too long, so that during the formation of the initial stitch of a stitch group including several stitches, the needle threads securely interlock with the locking threads and the ends of the needle threads are completely pulled through the work to the underside thereof. In embroidering machines having embroidering heads equipped with a plurality of needles assembled into a group and where each needle is threaded with a thread of its own and only one needle can be brought into the working position at a time, it is further required to keep the thread ends carried by needles in a rest position, away from the working area, to avoid their inadvertent being picked up during the operation.

In another prior art embroidering machine (Swiss Pat. No. 65,330), the presser feet are designed as thread clamps. After making an embroidery stitch group, the embroidering frame carrying the work is displaced until the needle threads extending from the needle to the work come to lie in front of a receiving slot of the presser feet. Then, by means of an elongated slide moved along the presser feet, the needle threads are pushed, one after the other, into the clamps of the presser feet and immediately cut. Since in this embroidering machine all the needles are moved simultaneously, the device is not suitable for embroidering machines having embroidering head with a group of individually operable needles. Further, since the pressure feet are provided at locations which are laterally spaced from the respective needles, they cannot satisfactorily keep the work down in the close proximity of the needles, so that at the withdrawal of the needles from the work, the work may partly be taken along and thus flutter. Another disadvantage is that due to the use of an elongated slide traveling along the presser feet, the embroidering machine requires much space.

Still another prior art embroidering machine (U.S. Pat. No. 3,349,733) comprises a plurality of needles, drivable by groups, and an equal number of clamping or holding devices for the needle threads, which are provided laterally of the needles and closely spaced from the work. With the last stitch of a stitch group done, the frame carrying the work is displaced through a relatively long distance, whereby the needle thread portions extending from the needles to the work are brought into the proximity of the clamping devices. At the same time, further thread lengths are pulled off the supply bobbins. To bring the needle threads into the open clamping jaws of the clamping devices, all clamping devices are moved in the direction of the needle threads and then closed. Upon cutting the threads, the needle-thread ends carried by needles which will not be used in the next embroidering operation are retained in the respective clamping devices, while the other needle-thread ends are released prior to the start of the initial stitch.

Since the clamping devices are closely spaced from the work, there is a risk, even with a work stretched in a vertical plane and horizontally reciprocating needles, that the needle-thread ends hanging from the closed clamping devices will be picked up during the embroidering operation by the adjacent, driven needles and worked into the embroidery. Clamping devices in such arrangement are therefore, unsuitable for embroidering machines in which the work extends horizontally and the needles are moved vertically. Another disadvantage is that after the last stitch in a stitch group, the frame carrying the work must be displaced through a relatively large distance, to get the needle thread to the clamping devices. If, for example, after a change to another color of the needle threads, the next stitch is to be made in close proximity of the last stitch, the frame or work must first be returned into its initial position.

SUMMARY OF THE INVENTION

The present invention is directed to an embroidering machine in which the devices holding the needle-thread ends are relatively remote from the work, and in which, during the further pull, clamping, and cutting of the needle threads, the work remains in its position occupied at the termination of the last stitch of a stitch group.

An object of the present invention is thus the provision of an embroidering machine comprising a plurality of embroidering heads equipped with a number of needles which form a group and are threaded each with a thread of its own, with only one threaded needle being operable to sew at a time, a presser foot mechanism with presser foot which is cyclically movable upwardly and downwardly and provided with holes for the passage of the needles. A thread cutting device and holding device for the needle threads is provided and, upon termination of an embroidering operation, the presser foot is movable substantially transversely to a longitudinal axis of the needles so that, after a thread cutting operation, the presser feet can be lifted into a position above their usual top dead center position.

By the provided movement of the presser feet in a direction transverse to the longitudinal axis of the needles, a pull is exerted on the thread portions extending vertically between the needles and the work, whereby a further thread portion is pulled off the respective supplies. This ensures that upon cutting the threads, the needle-thread end portions carried by the needles are sufficiently long for the next stitch-forming operation. Then, after the thread cutting operation, the presser feet are lifted so far beyond their upper dead center position of their cyclic up and down motion, that they introduce the needle thread ends into the holding or clamping devices which are relatively remote from the work. The needle threads are thus further pulled off and introduced into the holding devices due to the respective motion of the presser feet. The work can therefore, remain in this position, occupied at the termination of the last formed stitch, with the further favorable result that the control program for the advance of the work or the frame is not interrupted by the thread pulling, cutting, and clamping operations.

In their uppermost position, the presser feet are lifted above the edge of the frame carrying the work. Therefore, with the simultaneous use of a plurality of small frames, the frames can be displaced from one embroidering head to the other while passing under the presser feet in their uppermost position.

Another object of the invention is to provide an embroidering machine wherein the supports of the presser feet are mounted on a shaft and two different alternately effective drive mechanisms are provided for driving this shaft. The presser feet thus execute all their motions in a manner most simple to achieve in design, namely along a circular path. Since during this motion, the presser feet are displaced not only in the direction of the longitudinal axis of the needle, but also transversely thereto, the intermittent pulling of the needle threads is effected by the pivotal motion of the presser feet alone.

During the formation of initial stitches, the minimum length of the needle thread end portions needed for securely interlock the needle threads with the locking threads is not a constant dimension, it depends on the thickness of the work and the elasticity of the threads. Another object of the invention is thus to provide a second drive mechanism of the presser foot shaft with a controllable, geared motor which can be stopped as desired, that makes it possible to adjust the height of the presser feet stroke, determining the extenstion of the needle thread pulling, and thus to exactly adjust the length of the needle-thread end portions.

By using a tie rod provided with an idle-stroke device, for example a pin-and-slot joint, the drive motions produced by the first drive mechanism to move the presser feet cyclcally up and down are taken up by the idle-stroke device and prevented from being transmitted to the geared motor.

A further object of the present invention is to provide an embroidering machine wherein the drive mechanism includes a toggle joint having two arms, with one arm being pivotally connected to an adjusting lever for adjusting the one arms position. This makes it possible to vertically displace the range of the cyclic up and down stroke of the presser feet and thus to adapt to different thicknesses of the work.

A still further object is to provide clutch means between the presser feet and support so that the supports of the presser feet can be disengaged from the presser foot shaft, if needed.

Another object of the present invention is to provide an embroidering machine wherein the holding device for the ends of the needle threads comprise a plate which shields the ends of the needles in their raised or rest positions and which includes at least one chamber with an open downwardly extending and upwardly extending end with means for directing compressed air through a compressed air nozzle upwardly through the chamber.

In the holding device for needle thread ends, the compressed air flowing into the chamber from the air nozzle and has the effect of producing an underpressure at the lower end of the chamber, so that the needle-thread ends lifted by the presser feet are pulled into the chamber by suction and are retained therein as long as the air flows through the chamber. The chamber is so dimensioned that the needle thread ends of all of the needles of an embroidering head can be received and retained. The holding power of the air stream, however, is small enough to make it possible to withdraw the needle thread of the driven needle, during the downward motion thereof, from the chamber without an appreciable force, in order to make an initial stitch.

The needle-thread ends retained by the holding device and belonging to needles which are not used during an embroidering operation are prevented from getting into the path of motion of the driven needles due to the provision that the holding devices are disposed at a relatively large distance from the work. This precautionary measure is now further supported by the fact that the needle thread ends extend in the chambers from below upwardly thus in a direction away from the work.

To reduce the consumption of compressed air, a clamping element is accommodated in the chamber of each holding device, which is non-positively held in clamping position but can be moved into a way-clearing position by the air flowing therethrough. The clamping element may be designed as a hinged flap, for example, or a freely movable pin applying by gravity against extensions provided in the chamber.

An object of the present invention is also to mount the plate of the holding device on a horizontal axis and connect jump action means to the plate. Accordingly, each holding device can be swung from a working position in which the plates shield the points of the needles which are in rest position, into a rest position in which these needles are freely accessible for threading.

Another object of the invention is to provide an embroidering machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is explained in the following with reference to the drawings in which.

DESCRIPTION OF THE PREFERRED EMBODIMENT

Figure 1:
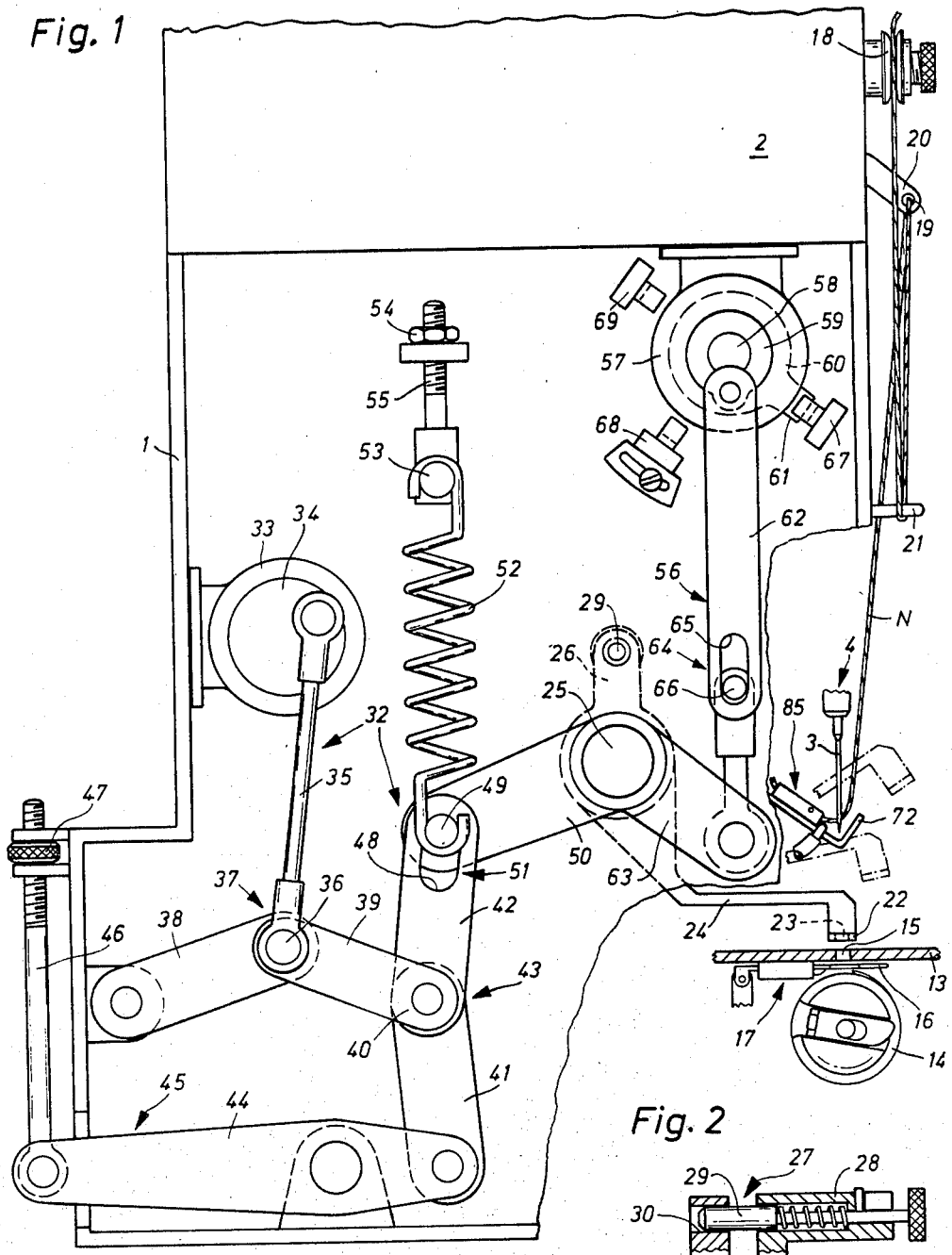
FIG. 1 is a partial view of an embroidering machine, with the shown needle being disengaged from the needle bar, i.e in its rest position.
Figure 3:
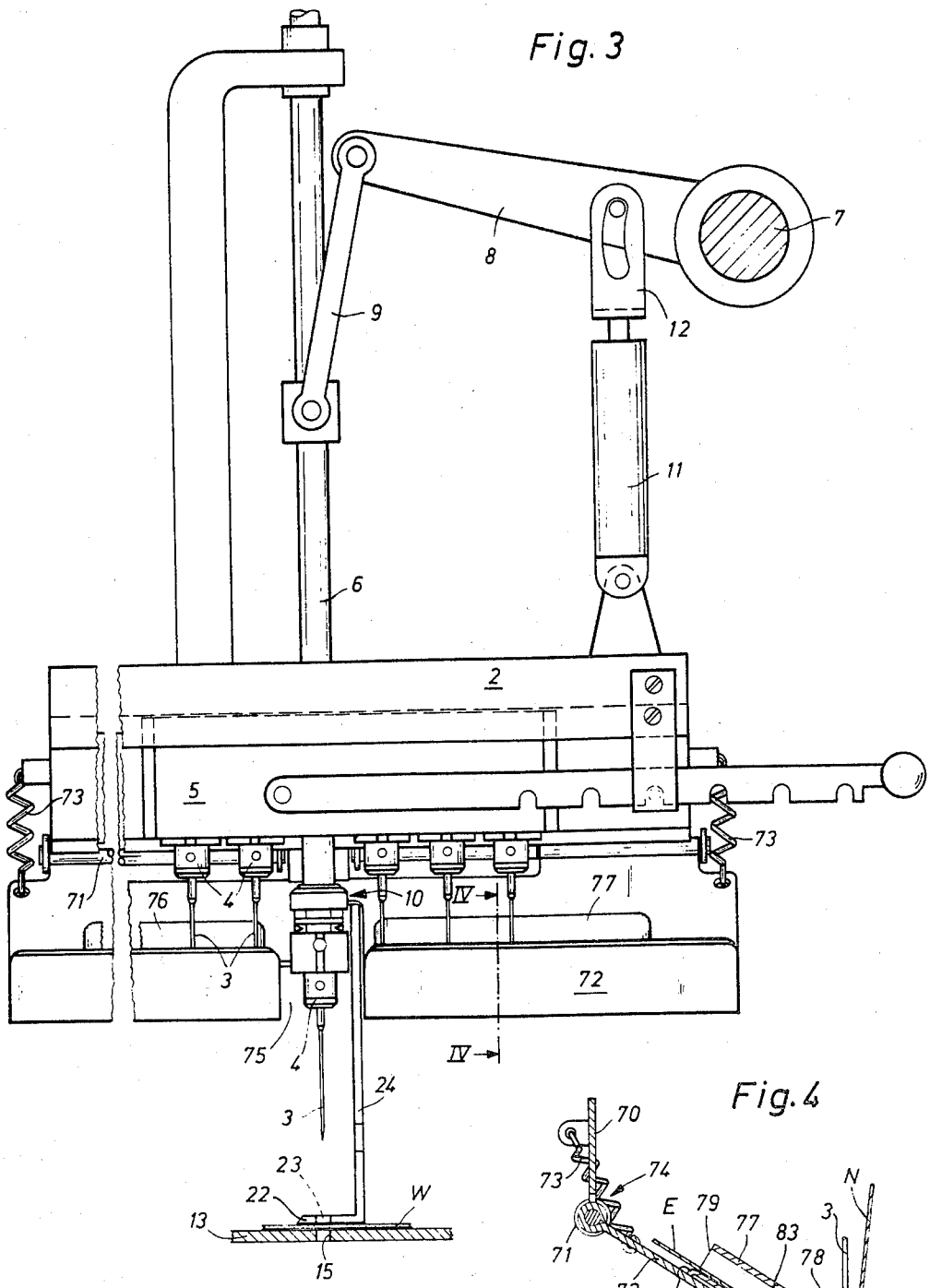
FIG. 3 is an enlarged view of a holding device and of the needle bar drive which is turned through 90° to clearly illustrate the design.
Figure 4:
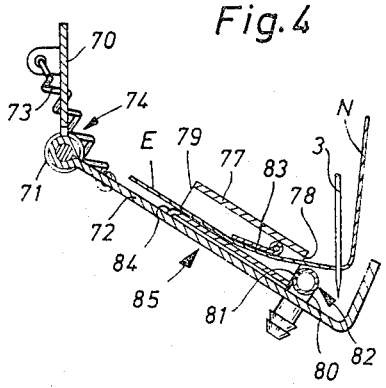
FIG. 4 is a sectional view taken along the line IV—IV of FIG. 3, with the needle in rest position.

Turning to the drawings, the embroidering machine of the invention comprises a housing 1 with a plurality of embroidering heads 2 of which only one is shown in FIGS. 1 and 3.

Each embroidering head 2 is equipped with a plurality of needles 3 which are to be threaded with different threads and form together a needle group. Needles 3 are clamped in needle holders 4 which are received in a horizontally displaceable magazine 5.

Each embroidering head 2 is provided with a single needle bar 6 which is driven from an oscillating shaft 7 through a crank 8 and a link 9. Needle bar 6 can be connected to one of needle holders 4 by means of a coupling mechanism 10 disclosed in German patent application Pat. No. 29 27 142.9. To engage or disengage needle holders 4, needle bar 6 is lifted, by means of an air cylinder 11 which is connected through a forked head 12 to crank 8, into an engagement-stroke position which is higher than the upper working-stroke end position. That is why the needle holders 4 and needles 3 disengaged from the needle bar 6 are kept in a lifted position which is more remote from the workpiece W placed on a bed plate 13, than their upper dead center position during an embroidering operation.

The needle 3 which is connected to needle bar 6, thus in working position, cooperates with a rotary hook 14 mounted below bed plate 13. Bed plate 13 is provided with a needle hole 15 for the passage of needle 3. A horizontally movable thread catcher 16 of a thread cutting device 17 is disposed between bed plate 13 and rotary hook 14. Each needle 3 carries a needle thread N which is delivered to the needle from a supply device, for example a spool of yarn (not shown) and passed therebetween about an engageable and disengageable thread tightener 18 and a thread guide 21, and through the eye 19 of an oscillating thread take-up lever 20.

Figure 2:
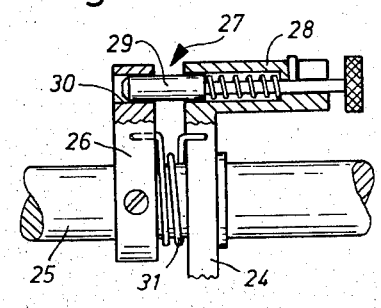
FIG. 2 is a partly sectional view of a clutch by which the presser foot supports are connected to the presser foot shaft.

To hold the workpiece W flat in the stitch forming area, each embroidering head 2 is associated with a pressure foot 22 having a hole 23 for the passage of the vertically reciprocating needle 3. Presser foot 22 is secured to a support 24 mounted for pivoting about a presser foot shaft 25 which is common to all the presser feet 22. As shown in FIG. 2, support 24 is associated with a crank 26 which is non-rotatably fixed to shaft 25 and can be connected to support 24 through a clutch 27. Clutch 27 comprises a spring-loaded pin 29 which is displaceably received in an extension 28 of support 24 and, in engaged position of the clutch, engages a bore 30 of crank 26. Presser foot shaft 25 further carries a helical torsion spring 31 holding presser foot 22 in a lifted position as long as pin 29 is retracted.

To reciprocate presser feet 22 periodically up and down during the embroidering operation, presser foot shaft 25 is connected to a drive mechanism 32 receiving its motion from a motor 33. Motor 33 also drives the take-up levers 20 and needle bars 6 of embroidering heads 2 and the rotary hooks 14, through suitable transmission elements (not shown). The motor shaft carries a crank disc 34 secured thereto and drives a link 35. Link 35 acts on the toggle joint 36 of a toggle mechanism 37 having arms 38 and 39. Arm 38 is hinged at a fixed location to housing 1, while arm 39 acts on the toggle joint 40 of another toggle mechanism 43 formed by two arms 41 and 42. Arm 41 is hinged to the adjusting lever 44 of an adjusting device 45 comprising a spindle 46 and an axially fixed set wheel 47.

Arm 42 of toggle mechanism 43 has a slot 48 receiving a pin 49 which is provided on a crank 50 secured to presser foot shaft 25. Arm 42 and crank 50 are thus connected to each other through a pin-and-slot joint 51. A tension spring 52 is attached by one of its ends to pin 49 and its other end to a pin 53 which is secured to a tension adjusting bolt 55 adjustable by a nut 54. Arm 41 is thus an adjustment arm and arm 42 is thus a motion accepting arm.

Presser foot shaft 25 is further associated with a drive mechanism 56. Drive mechanism 56 comprises a drive motor 57 with an output shaft 58 to which a crank disc 59 and a control disc 60 with an extension 61, are secured. Crank disc 59 is connected, through a two-part tie rod 62, to a crank 63 which is secured to presser foot shaft 25. The two parts of tie rod 62 are connected to each other by an idle-stroke joint 64 comprising a slot 65 provided in one part of the tie rod and a pin 66 secured to the other tie rod part and engaging slot 65. In the path of motion of extension 61, three slot-type proximity switches 67, 68 and 69 which are known per se, are provided, for switching drive motor 57 on and off in a controlled mannerwith the location of the intermediate switch 68 being adjustable.

To each embroidering head, 2, a holding plate 70 is secured carrying a plate 72 hinged thereto at 71. Plate 72 has an L-shaped lower end. Along with two springs 73 attached by one end to plate 70 and by their other end to plate 72, plate 70 and 72 form a jump-action switching mechanism 74. Plate 72 is provided with a stepped aperture 75, so that needle bar 6 with needle holder 4 and needle 3, can freely pass therethrough, and support 24 carrying presser foot 22 can swing upwardly.

At either side of aperture 75, a chamber 76,77, respectively, is formed on the front side of plate 72. chambers 76,77 have an inlet 78 on their lower end and an outlet 79 on their upper end. At the lower end of each chamber 76, 77 a tube 80 is provided, having one end closed and the other end connected to a compressed-air source (not shown). On their side facing chamber 76 or 77, the two tubes 80 are provided with a plurality of bores 81 which act as air nozzles 82 turned in the direction of chambers 76, 77, thus upwardly. Each chamber 76,77 accommodated a hinged flap 83 resting by gravity on the bottom 84 of chamber 76 or 77.

Plate 72, chambers 76,77, air nozzles 82 including tubes 80, and flaps 83 form together a holding device 85 for the end E of needle threads N. Holding device 85 can be pivoted by hand into two different positions in which it is held by the spring force of a jump-action switching mechanism. In the working position of holding device 85 shown in the drawing, L-shaped plate 72 shields the points of needles 3 which are in rest position, so that holding device 85 at the same time acts as a needle guard reducing the risk of injuries. In its rest position (not shown), holding device 85 is pivoted rearwardly and the needles 3 in rest position are freely accessible for threading.

The embroidering machine operates as follows:

Since the motions of the different mechanical parts are identical in all embroidering heads 2, the operation of a single embroidering head is discussed.

To perform an embroidering operation, motor 33 is started. In a manner known per se, the motor drives needle bar 6, thread take-up lever 20, and rotary hook 14, as well as link 35 of drive mechanism 32. The motions of link 35 are transmitted, through the toggle mechanisms 37, 43 and the pin-and-slot joint 51 which is held in its upper end position by tension spring 52, to crank 50, so that presser foot shaft 25 executes rotary oscillatory motions.

If foot presser 22 is operatively connected through clutch 27 to presser foot shaft 25, the rotary oscillatory motion of shaft 25 causes a reciprocating up and down motion of presser foot 22, the stroke being about 4 mm. This motion of presser foot 22 is synchronized with the motion of needle bar 6 of the effect that as needle 3 is engaged in workpiece W, the presser foot passes through the lower dead center of its motion in which it bears against the workpiece W, so that the workpiece is prevented from being taken along at the withdrawal of needle 3. During the period in which needle 3 is withdrawn from workpiece W, the presser foot passes through the upper dead center of its motion so that it does not hinder the feed motion of workpiece W taking place during this period. By turning set wheel 47, the vertical range of motion of presser foot 22 can be displaced and thus adjusted to the thickness of the work.

The rotary oscillatory motion imparted to the presser foot shaft 25 by drive mechanism 32 is also transmitted to crank 63 and the lower part of tie rod 62. This oscillatory motion however, is not transmitted farther since it is taken up by idle-stroke joint 64. Therefore, the upper part of tie rod 62, and drive motor 57, remain unaffected by the oscillatory motion of presser foot shaft 25.

Upon termination of the last stitch of a stitch group including a plurality of stitches, motor 33 is switched off, and needle bar 6 is stopped in the upper dead center position of its working stroke. The stopping of motor 33 also stops take-up lever 20 and presser foot 22. Further, thread tightener 18 is opened.

Following the opening of thread tightener 18, drive motor 57 is started, so that the upper part of tie rod 62 is lifted by crank disc 59. As soon as the lower end of slot 65 butts against pin 66, the lower part of tie rod 62 is also lifted whereby crank 63 and presser foot shaft 25 are swung in the counterclockwise direction, as viewed in FIG. 1. This displaces pin 49 away from the upper end of slot 48, against the action of tension spring 52, while presser foot 22 is lifted above the upper dead center of its periodic up and down motion, into the mid-position indicated in dash-dotted lines in FIG. 1. Since during the upward motion, presser foot 22 follows a circular path, the lateral component of this motion, which is transverse the longitudinal axis of needle 3, causes the needle thread portion N extending from needle 3 to work W to be withdrawn sidewardly. Thereby, a further length of the thread is pulled off the supply around or through thread guide 21, bore 19 of take-up lever 20, and thread tightener 18.

The distance through which presser foot 22 is lifted to pull off the further length of thread is controlled by slot-type proximity switch 68. As extension 61 enters the slot of switch 68, drive motor 57 and, thereby, the upward motion of presser foot 22, are stopped. After the thread portion is pulled off, the locking thread and the needle thread are cut by means of a thread cutting device 17. The cut thread ends connected to work W remain at the underside thereof and are relatively short. The length of the thread end E carried by needle 3 depends on the length of the portion previously pulled off and is dimensioned to obtain a secure interlocking of the locking thread with the needle thread N during formation of the next stitch. Should it turn out that the thread end E carried by needle 3 is too short or too long, its length can be adjusted by resetting slot-type proximity switch 68.

If, after cutting the thread, it is intended to make with the same needle thread N a new stitch group, drive motor 57 is restarted to rotate in the opposite direction until extension 61 enters the slot of proximity switch 67 whereby motor 57 is stopped again. Due to the reversal of motor 57, presser foot 22 returns to its normal working position and a new stitch forming operation can start.

If, after cutting the thread, it is intended to continue the embroidering with another needle thread N, drive motor 57 is restarted in the same direction as before during the pulling out the thread portion, until extension 61 enters the slot of proximity switch 69, whereby motor 57 is stopped. This rotation of motor 57 moves presser foot 22 into its upper position indicated in dash-dotted lines in FIG. 1, in which the needle thread end E still extending through hole 23 of the presser foot is brought into a position favorable for catching it by means of holding device 85.

After presser foot 22 has reached this upper position, air nozzles 82 are supplied with compressed air, so that an air stream is forced through chambers 76,77. This air stream produces an underpressure in the zone of inlets 78 of chamber 76, 77, causing the needle thread end E lifted by presser foot 22 to be pulled out of hole 23 and taken by suction into one of the two chambers 76,77. Needle-thread end E is thus moved past and beyond flap 83 which is lifted by the air stream, to protrude from outlet 79 along with those needle-thread ends E which are carried by the needles 3 which are in rest position in front of the respective chambers 76 or 77. Upon introducing needle-thread end E, the compressed air supply is switched off, so that flaps 83 sink under their own weight and clamp the needle-thread ends E extending through chambers 76,77 against the bottom 84 of the chambers. In this way, needle-thread ends E are prevented from slipping out of chambers 76,77.

As soon as the needle thread E carried by the needle 3 which is connected to needle bar 6 is clamped in holding device 85, motor 57 is started again and presser foot 22 returns into its normal working position i.e. the lowermost position according to FIG. 1. This pivotal return motion ends at the instant at which extension 61 enters the slot of proximity switch 67 and motor 57 is stopped. Needle bar 6 is then lifted by air cylinder 11 into engagement-stroke position which is higher than its upper end position during a working stroke. As comprehensively described in the mentioned German patent application Pat. No. 29 27 142.9, this stroke in excess of needle bar 6 causes needle holder 4 to disengage from needle bar 6. Thereupon, by shifting magazine 5, the needle holder 4 carrying the needle with the thread N provided for the next stich forming operation is brought into the path of motion of needle bar 6 and operatively connected thereto by lowering the needle bar. The needle-thread end E carried by the presently driven needle 3 is thereby pulled back from below the respective flap 83 without a particular effort, and thereby withdrawn from holding device 85.

Since while shifting magazine 5 it may happen that some of the needle-thread ends E clamped by flaps 83 are pulled out of chamber 76, 77 and come to lie in the trough formed on plate 72, air nozzles 82 are supplied with compressed air once more for a short period of time after the thread change, so that needle threads E which might have slipped out of chambers 76, 77 are taken in again.

While a specific embodiment of the invention has been shown and described in detail to illustrate the application of the principles of the invention, it will be understood that the invention may be embodied otherwise without departing from such principles.

What is claimed is:

1. An embroidering machine comprising: a group of needles each for carrying separate thread; needle drive means for engaging one needle at a time and moving said one needle from a rest position into an operating position; a presser foot movable cyclically with movement of said one needle in its operating position, between a lower dead center position and an uper dead center position, and having an opening for the passage of said one needle; presser foot drive means connected to said presser foot for moving said presser foot between its upper and lower dead center positions and for moving said presser foot upwardly beyond it upper dead center position; a cutting means for cutting the thread of said one needle to form an end portion of the thread; and holding means for securing the end portion of the thread after the thread is cut.

2. An embroidering machine according to claim 1, wherein said presser foot drive means comprises a support connected to said presser foot, a shaft connected to said support which is rotatable to move said presser foot substantially transversely to a longitudinal axis of said one needle and a motor with crank disc connected to said shaft for cyclically rotating said shaft first in a first direction and then in a second direction.

3. An embroidering machine according to claim 2, including a toggle mechanism connected between said crank disc and said shaft having one adjustment arm for adjusting the position of said shaft and one motion accepting arm for accepting motion of said shaft other than the motion imparted to said shaft by said motor.

4. An embroidering machine according to claim 3, wherein said presser foot drive means further includes a second motor and second crank disc connected to said shaft for rotating said shaft to move said presser foot upwardly beyond its upper dead center position.

5. An embroidering machine according to claim 2, including a clutch between said shaft and said presser foot support for selectively engaging and disengaging said presser foot support to and from said shaft.

6. An embroidering machine according to claim 1, wherein said holding means comprises a shielding plate, means for moving said shielding plate into a position shielding points of said needles when said needles are in their rest position, means defining a chamber with an open lower and open upper end for accepting the thread end portions and compressed air means for blowing air upwardly through said chamber to move said thread end portions to said chamber.

7. An embroidering machine according to claim 6, including passive clamping means in said chamber for clamping the end portions in said chamber.

8. An embroidering device according to claim 6, including jump action means connected to said shielding plate, said shielding plate being pivotally mounted about a horizontal axis, said jump action means being operable to hold said shielding plate in a position shielding said needle points and to hold said shielding plate in a position away from said needles.

9. An embroidering machine comprising a plurality of embroidering heads each equipped with a plurality of needles which form a group and are threaded each with a thread needle operating means engaged with one needle at a time to bring one needle at a time into a working position from a non-working position, a presser foot mechanism with presser feet which are cyclically movable upwardly and downwardly and provided with holes for the passage of the needles, and a thread cutting device and holding devices for the needle thread end of the needle threads, the presser foot mechanism being operable upon termination of an embroidering operation to move the presser feet (22) substantially transversely to a longitudinal axis of the needles (3) and after a thread cutting operation, to lift the presser feet in the direction of the holding devices (85) into a position above an upper dead center position of the cyclic upward and downward motion of the presser feet.

10. An embroidering machine according to claim 9, wherein the presser feet (22) are secured to supports (24) which are mounted on a presser foot shaft (25), the presser foot mechanism (32) driving the presser foot shaft (25) and imparting the cyclic upward and downward motion to the presser feet (22) comprising at least one toggle mechanism (43) having a toggle joint (40) connected to a transmission element (39) effecting the cyclic motion and having one of its arms (42) connected, by means of a pin-and-slot joint (51) which is non-positively retained in one end position, to a crank (50) mounted on the presser foot shaft (25), the presser foot shaft (25) being connected to a second drive mechanism (56) which operates to overcome the force causing the non-positive retention of the pin-and-slot joint (51).

11. An embroidering machine according to claim 10 wherein the second drive mechanism (56) of the presser foot shaft (25) comprises a controllable geared motor (57) with a crank disc (59), a crank (63) secured to the presser foot shaft (25), and a tie rod (62) which is provided with and idle-stroke device and connects the crank disc (59) to the crank (63).

12. An embroidering machine according to claim 10, wherein another arm (41) of the toggle mechanism (43) is hinged to an adjusting lever (44) which is connected to an adjusting device (45).

13. An embroidering machine according to claim 10, wherein the supports (24) of the presser feet (22) are connected to the presser foot shaft (25) by means of a clutch (27).

14. An embroidering machine according to claim 9 wherein the holding device (85) for the ends of the needle threads comprise a plate (72) by which points of the needles (3) in their non-working position are shielded and on which at least one chamber (76,77) is formed which is open upwardly and downwardly and is associated with an upwardly directed compressed-air nozzle (82) which is located at the lower end of the chamber.

15. An embroidering machine according to claim 14, wherein the at least one chamber (76,77) accommodates a clamping element (83) which is non-positively held in a clamping position and can be moved into a passage-clearing position by compressed air flowing through the chamber (76,77).

16. An embroidering machine according to claim 14, wherein the plate (72) is mounted for pivoting about a horizontal axis and connected to a jump-action switching device (74).

* * * * *